US005669300A

United States Patent [19]

Watanabe

[11] Patent Number: 5,669,300

[45] Date of Patent: Sep. 23, 1997

[54] PROCESS FOR PERFORATING A SOLVENT SOLUBLE STENCIL

[75] Inventor: Hideo Watanabe, Tokyo, Japan

[73] Assignee: Riso Kagaku Corporation, Tokyo, Japan

[21] Appl. No.: 622,446

[22] Filed: Mar. 12, 1996

Related U.S. Application Data

[62] Division of Ser. No. 322,700, Oct. 13, 1994, abandoned.

[30] Foreign Application Priority Data

Oct. 14, 1993 [JP] Japan ..... 5-257296

[51] Int. Cl.[6] ..... B41N 1/24

[52] U.S. Cl. ..... 101/128.21; 101/127

[58] Field of Search ..... 101/114, 127, 101/127.1, 128.21, 128.4, 129, 401.1; 427/143, 273; 428/195

[56] References Cited

U.S. PATENT DOCUMENTS

| | | | |
|---|---|---|---|
| 628,315 | 7/1899 | Haberstroh | 101/128.21 |
| 1,606,217 | 11/1926 | Gestetner | 101/128.21 |
| 4,597,829 | 7/1986 | Sato et al. | 101/128.4 |
| 5,154,121 | 10/1992 | Schneider | 101/401.1 |
| 5,174,203 | 12/1992 | Maeda | 101/129 |

FOREIGN PATENT DOCUMENTS

| | | | |
|---|---|---|---|
| 12395 | 1/1986 | Japan | 101/128.21 |

*Primary Examiner*—Stephen R. Funk

*Attorney, Agent, or Firm*—Fay, Sharpe, Beall, Fagan, Minnich & McKee

[57] ABSTRACT

A stencil printing sheet and a process for perforating the same. The stencil printing sheet is perforated by using a solvent-soluble resin in the range of 0.1–100 μm in thickness with a solvent which has a solubility of 100 seconds or less and a viscosity of solution of 1000 cps or less at 20° C.

5 Claims, 1 Drawing Sheet

PROCESS FOR PERFORATING A SOLVENT SOLUBLE STENCIL

This is a divisional of application Ser. No. 08/322,700 filed on Oct. 13, 1994 now abandoned.

BACKGROUND OF THE INVENTION

1. Field of the Invention

The present invention relates to a stencil printing sheet and a process for perforating the same. Specifically, it relates to a stencil printing sheet having a solvent-soluble resin layer and a process for perforating the same.

2. Description of the Prior Art

In the prior art, a heat-sensitive stencil sheet is known which is produced by laminating a thermoplastic resin film on a porous substrate with an adhesive. A stencil-making of this heat-sensitive stencil sheet is carried out by means of (1) a process of superposing a hand written or preliminarily prepared manuscript on a heat-sensitive stencil sheet and then perforating by melting a thermoplastic resin film using the heat generated from e.g., flash lamp, infrared lamp, (2) a process of bringing a thermal head which generates a dot-like heat in accordance with electrical signals from letter or picture information, in contact with a heat-sensitive stencil sheet, and perforating by melting a thermoplastic resin film of the sheet, and other processes.

However, according to the stencil-making process described above, it was necessary to experience a complicated process of bringing a manuscript heated by absorbing light or thermal head in contact with a heat-sensitive stencil sheet, conducting the heat to the thermoplastic resin film of a heat-sensitive stencil sheet to melt the thermoplastic resin film and then shrinking the molten material to perforate the thermoplastic resin film, the stencil-making process had the disadvantages in that, for example, (1) a perforating failure was produced by the contacting failure between a thermoplastic resin film and a manuscript or thermal head which absorbed heat; (2) a perforating failure was produced by the nonuniformity in press pressure of a thermal head, resulting in producing wrinkles in a heat-sensitive stencil sheet; (3) the molten material of a thermoplastic resin film was adhered to a thermal head, resulting in producing a conveying failure of heat-sensitive stencil sheet; and (4) since the molten material was left in a perforated portion, the ink permeability was prevented, resulting in printing failure.

In recent years, a further improvement in quality of heat-sensitive stencil sheet is demanded. It is demanded to provide such a heat-sensitive stencil sheet that satisfies the smoothness of a thermoplastic resin film, the separating property of the thermoplastic resin film from the manuscript or thermal head, the melting property due to heat, and the shrinkability of a thermoplastic resin film, the adhesive strength between a thermoplastic resin film and a porous substrate, and the mechanical strength and abrasion of the porous substrate, and therefore, the condition for producing heat-sensitive stencil sheet becomes complicated and there was the problem that the production cost was accordingly increased.

SUMMARY OF THE INVENTION

It is a main object of this invention to solve the above-mentioned problems in the prior art and provide a stencil printing sheet and a process for producing the same in which there are no perforating failure at a time of stencil-making, no generation of wrinkles, no conveying failure and no printing failure.

The invention to be claimed mainly in this application will be as follows:

(1) A stencil printing sheet which comprises a porous substrate and a resin film laminated thereon, wherein the resin film is a solvent-soluble resin film having a thickness in the range of 0.1–100 μm.

(2) A stencil printing sheet according to item (1), wherein a solubility of the resin film to the solvent at 20° C. is within 100 seconds in terms of a resin film having a thickness of 10 μm.

(3) A stencil printing sheet according to item (1) or (2), wherein a viscosity of a solution dissolving 10% by weight of the resin in the solvent is 1000 cps or less at 20° C.

(4) A process for perforating a stencil printing sheet by using a solvent, wherein the stencil printing sheet comprises a porous substrate and a solvent-soluble resin film laminated thereon, a solubility of the resin to the solvent being within 100 seconds at 20° C. in terms of a resin film of 10 μm in thickness and, a viscosity of a solution dissolving 10% by weight of the resin in the solvent being 1000 cps or less at 20° C.

DETAILED DESCRIPTION OF THE PREFERRED EMBODIMENTS

Figure 1:
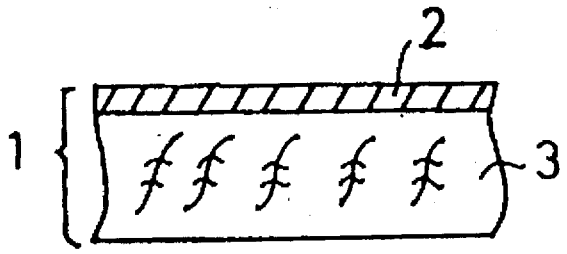
FIG. 1 is a sectional view showing a stencil printing sheet as a preferred embodiment of the present invention.
Figure 2:
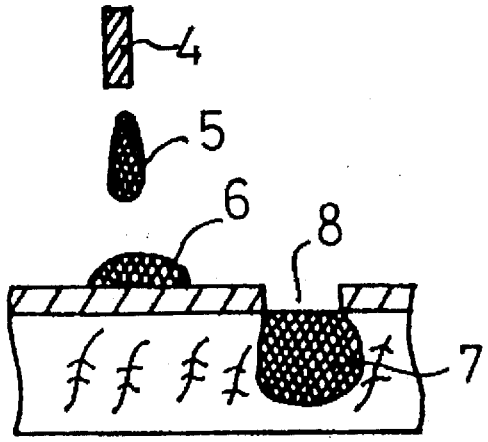
FIG. 2 is an explanatory view showing a perforating of stencil printing sheet according to the present invention.

The detailed description of the present invention will be given specifically with reference to examples in the following. It should be understood, however, that these examples do not limit the scope of the present invention.

In these figures, reference characters 1 to 8 means the following:

1. stencil printing sheet;
2. solvent-soluble resin film;
3. porous substrate;
4. ejecting means;
5. ejected solvent;
6. contacted solvent;
7. resin-dissolved solution permeated into porous substrate; and
8. perforated portion;

A solvent-soluble resin film to be used in this invention contains a thermoplastic or thermosetting resin soluble in water or an organic solvent and others as a main component.

As for a resin soluble in an organic solvent, for example, polyethylene, polypropylene, polyisobutylene, polystyrene, polyvinyl chloride, polyvinylidene chloride, polyvinyl fluoride, polyvinyl acetate, acrylic resin, polyamide, polyimide, polyester, polycarbonate, polyurethane or the like may be used. These resins may be used independently, or in an admixture thereof. Copolymerized form of these resins may be used as well.

As for a water-soluble resin, a resin soluble in water or in water-miscible organic solvent, such as polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal, polyacrylamide or the like may be used. These resins may be used independently, or in an admixture thereof. Copolymerized form of these resins may be used as well.

In addition to the above resin components, dyestuffs, pigments, fillers, binders, hardeners and others can be also contained in the solvent-soluble resin film described above.

The thickness of the solvent-soluble resin film is preferably in the range of 0.1 μm–100 μm, and more preferably, in the range of 1 μm–50 μm. When the thickness thereof is less than 0.1 μm, the strength of the resin film becomes insufficient and when it exceeds 100 μm, a large quantity of the solvent which dissolves the resin film may be required and the dissolution of the resin film often becomes insufficient.

In this invention, the solvent-soluble resin film preferably has a proper solubility from the stand point of the perforating property thereof. Specifically, the solubility of the resin film in a solvent may be so that in the case of the resin film having a thickness of 10 μm, it is dissolved preferably within 100 seconds and more preferably within 50 seconds. In the case that the solubility of the resin film exceeds 100 seconds, water or organic solvent to be used when the stencil printing sheet is engraved evaporates from the surface of the resin film before dissolving the resin film, resulting in the insufficient perforating of the resin film.

In this specification, the solubility is defined by a time required for completely dissolving 1.0 g of the solvent-soluble resin film having a thickness of 10 μm in 1000 g of a solvent for the resin film at 20° C. without stirring.

A viscosity of a solution dissolving 10% by weight of the resin in a solvent, i.e. the dissolved resin accounts for 10% of the solvent solution, at 20° C. is preferably 1000 cps or less, and more preferably, 500 cps or less at 20° C. In the case that the solution viscosity exceeds 1000 cps, a portion of the solution remains in the perforated portion due to the difficulty in permeating thereof into the porous substrate, water or organic solvent in such remaining solution evaporates and the resin component is solidified, resulting in preventing the passage of the ink.

As for a porous substrate to be used in the invention, Japanese paper or the like, woven or nonwoven cloth, gauze or the like made from natural fiber such as Manila hemp, pulp, Mitsumata (Edgeworthia papyrifera Sieb.), Kozo (Broussonetia kazinoki Sieb.), synthetic fiber such as that of polyester, nylon, vinylon, acetate fiber or the like, a thin leaf paper using metallic fiber, glass fiber or the like, independently or as a mixture thereof, can be exemplified. Each basis weight of these porous substrate is preferably in the range of 1 $g/m^2$–20 $g/m^2$, and more preferably, in the range of 5 $g/m^2$–15 $g/m^2$. When each basis weight is less than 1 $g/m^2$, the strength of the sheet becomes weak, and when it exceeds 20 $g/m^2$, the ink permeability often becomes bad at a printing time. Also, the thickness of the porous substrate is preferably in the range of 5 μm–100 μm, and more preferably, in the range of 10 μm–50 μm. When the thickness is less than 5 μm, the strength of the sheet still becomes weak, and when it exceeds 100 μm, the ink permeability at a printing time often becomes bad.

The stencil printing sheet of the present invention can be produced by e.g., a process (1) for laminating a solvent-soluble resin film to a porous substrate with an adhesive or sticking agent, a process (2) for applying a heat-adhesion to a resin film and a porous substrate, a process (3) for coating a resin solution dissolved or dispersed into a solvent on a porous substrate and then drying the same, a process (4) for coating a solvent or dispersed resin solution on a separating substrate and drying to form a resin layer, superposing a porous substrate on the formed resin layer and peeling off the separating substrate and other processes.

FIG. 1 is a sectional view showing a stencil printing sheet as a preferred embodiment of the present invention. In this stencil printing sheet 1, a solvent-soluble resin film 2 is formed on a porous substrate 3.

Since the stencil printing sheet of the present invention has a solvent-soluble resin film, once the resin film is brought in contact with a solvent which dissolves the resin film, the resin film in the contacted portion starts dissolving into the solvent and then, the resin film dissolves in the solvent up to its saturation in solubility. The solution which dissolved the resin film permeates into a porous substrate and the resin film corresponding to this portion is perforated. Since the solution which dissolved the resin film permeates into the porous substrate, the dissolved portion is not left in the perforated portion of the resin film and does not obstruct the perforation. In addition, the perforating property of the resin film can be adjusted by controlling the solubility of the solvent to the resin film and the quantity of the contacting solvent.

As for a solvent which dissolves the solvent-soluble resin film, each type solvent, such as aliphatic hydrocarbons, aromatic hydrocarbons, alcohols, ketones, esters, ethers, aldehydes, carboxylic acids, amines, low molecular heterocyclic compounds, oxides or water, can be exemplified. Specifically, hexane, heptane, octane, benzene, toluene, xylene, methyl alcohol, ethyl alcohol, isopropyl alcohol, n-propyl alcohol, butyl alcohol, ethylene glycol, diethylene glycol, propylene glycol, glycerine, acetone, methyl ethyl ketone, ethyl acetate, propyl acetate, ethyl ether, tetrahydrofuran, 1,4-dioxane, formic acid, acetic acid, propionic acid, formaldehyde, acetaldehyde, methylamine, ethylenediamine, dimethylformamide, pyridine, ethylene oxide and the like can be exemplified. These solvents can be used independently or in an admixture thereof. Furthermore, dyestuffs, pigments, fillers, binders, hardeners, antiseptics, wetting agents, surfactants, pH conditioners and others can be contained in the solvent.

The stencil-making of the stencil printing sheet described above may be carried out by either bringing a means, such as a brush pen soaked in a solvent, in contact with a solvent-soluble resin film directly, but it is preferable to feed the solvent to the resin film by a solvent ejecting device or the like in a non-contact condition so as to perforate and carry out the stencil-making of the stencil printing sheet.

As for a solvent ejecting device, there is exemplified such an apparatus that a nozzle, a slit, an injector, a porous material, a porous film or the like is connected to a liquid feed pump, a piezoelectric element or a heating element so as to eject the solvent intermittently or continuously in a dot or in a line form corresponding to each letter and picture signal.

According to the present process, it is possible to carry out the stencil-making of stencil printing sheet in a non-contact condition with the resin film to a stencil-making apparatus, there is no generation of wrinkles at a time of stencil-making. Also, differently from a conventional heat-sensitive stencil sheet, no molten material is left in the perforated portion and a brilliant printed matter can be obtained. Furthermore, the stencil printing sheet of the invention can be produced without need of any separating property, abrasion and mechanical strength of the sheet as required in the conventional heat-sensitive stencil sheet.

The stencil printing sheet obtained by the process of the invention can be applied to a general stencil printing process to obtain a printed matter. For example, a printed matter can be obtained by mounting an ink on a perforated stencil printing sheet, passing the ink through each portion perforated by press rolls, reduced pressure means or squeegee rolls, and transcribing the ink to a printing paper. As a printing ink, an oily ink usually used in stencil printing, water-base ink, water-in-oil emulsion ink, oil-in-water emulsion ink, and others can be used.

The present invention will be explained in detail by the following examples. It should be understood, however, that these examples do not limit the scope of the present invention.

EXAMPLE 1

A stencil printing sheet was produced by superposing a polyvinyl ether film having a thickness of 10 μm on a Japanese paper having a basis weight of 10 g/m$^2$ and passing the superposed Japanese paper through heat rollers at a temperature of 120° C.

The aqueous solution having the following composition was ejected onto the polyvinyl ether film surface of this stencil printing sheet in a letter-shaped pattern from an ejecting means provided with a nozzle of 8 dots/mm and a piezoelectric element connected thereto and a perforation was carried out by dissolving polyvinyl ether film in the ejected portion.

| | |
|---|---|
| Isopropyl alcohol | 20 parts by weight |
| Ethylene glycol | 10 parts by weight |
| water | 70 parts by weight |

The solubility of polyvinyl ether film in the above aqueous solution was 20 seconds, and also the viscosity of the aqueous solution of 10% by weight of the polyvinyl ether dissolved therein was 150 cps at 20° C.

Then, a printing paper was superposed on the side of the perforated polyvinyl ether film of the above stencil printing sheet, a black oily ink was mounted on the other surface of the stencil sheet and the ink was squeegeed by a blade, brilliant letters in the same shape as the perforated portion were printed in the printing paper.

EXAMPLE 2

An adhesive solution consisting of the following composition was coated on a polyester fiber cloth having a sieve opening of 200 mesh and dried off. Then, a polyvinyl alcohol film of 5 μm in thickness was superposed on this coated surface to give a stencil printing sheet.

| | |
|---|---|
| Polyurethane (solid content 30% by weight) | 50 parts by weight |
| Isocyanate | 5 parts by weight |
| Ethyl acetate | 25 parts by weight |
| Toluene | 20 parts by weight |

A solubility of polyvinyl alcohol film in the above aqueous solution was 35 seconds in terms of 10 μm in thickness and the viscosity of the aqueous solution which dissolves 10% of polyvinyl alcohol by weight was 200 cps at 20° C.

The polyvinyl alcohol film in this stencil printing sheet was dissolved and perforated in a letter shape by using the same aqueous solution and ejecting means as shown in Example 1, resulting in giving a good printed matter.

EXAMPLE 3

An adhesive solution consisting of the following composition was coated on a polyester fiber cloth having a sieve opening of 300 mesh and dried off. Then, a polycarbonate film of 6 μm in thickness was superposed on this coated surface to give a stencil printing sheet.

| | |
|---|---|
| Acrylic emulsion adhesive (solid content 50% by weight) | 50 parts by weight |
| Water | 50 parts by weight |

A mixed solvent consisting of the following composition was ejected in a letter shape to the stencil printing sheet described above from the ejecting means used in Example 1, and the polycarbonate film in the ejected portion was dissolved and perforated.

| | |
|---|---|
| Methyl ethyl ketone | 50 parts by weight |
| Toluene | 30 parts by weight |
| Isopropyl alcohol | 20 parts by weight |

A solubility of polycarbonate film in the above mixed solvent corresponds to 30 seconds in the case of calculating in the thickness of 10 μm, and the solution viscosity when 10% solution by weight of polycarbonate is dissolved was 400 cps at 20° C.

Subsequently, a black ink (HI-MESH, trademark of Riso Kagaku Corporation) for use in a portable stencil printing device (PRINT GOKKO PG-10, trademark of Riso Kagaku Corporation) was mounted on the polyester fiber cloth of the engraved stencil printing sheet, and this was superposed on a printing paper to carry out printing by means of PRINT GOKKO PG-10, resulting in printing brilliantly the similar letters to those of the perforated portions.

EXAMPLE 4

A resin solution consisting of the following composition was coated by a roll coater on a separating paper treated with silicone and dried off to obtain a solvent-soluble resin film of 3 μm in thickness thereon.

| | |
|---|---|
| Vinyl chloride - vinyl acetate copolymer | 20 parts by weight |
| Toluene | 50 parts by weight |
| Methyl ethyl ketone | 30 parts by weight |

Then, an adhesive solution consisting of the following composition was coated on a Japanese paper having a basis weight of 20 g/m$^2$ and dried off.

| | |
|---|---|
| Isoprene adhesive (solid content 40% by weight) | 50 parts by weight |
| Toluene | 50 parts by weight |

Then, the thus obtained solvent-soluble resin film on the separating paper was superposed on the adhesive layer on the Japanese paper and the separating paper was peeled off to give a stencil printing sheet.

The solubility of vinyl chloride- vinyl acetate copolymer into the mixed solvent described above corresponds to 40 seconds as calculated in a thickness of 10 μm, and the viscosity of 10% solution by weight was 300 cps at 20° C. A mixed solvent having the following composition was ejected in a letter shape on the surface of the resin film of this stencil printing sheet from the similar means as shown in Example 1 and the resin film in the ejected portions was dissolved to perforate the stencil printing sheet.

| | |
|---|---|
| Toluene | 50 parts by weight |
| 1,4-dioxane | 30 parts by weight |
| methyl isobutyl ketone | 20 parts by weight |

In the similar manner as shown in Example 3, a stencil-making was carried out to this stencil printing sheet to print using the perforated stencil printing sheet, resulting in giving a good printed matter.

EFFECTIVENESS OF THE INVENTION

According to the stencil printing sheet and the process for perforating the same of the present invention, since the stencil printing sheet of the invention can be perforated by a solvent in its non-contact condition, there is no generation of any perforating failure at a time of stencil-making, any wrinkles and conveying failure. Since the solubility is rapid, there is no generation of any perforating failure and further the dissolved resin component is not left in the perforated portions, the permeability of the ink becomes good and it is possible to print brilliant pictures thereby.

What we claim is:

1. A process for perforating a stencil printing sheet which comprises a porous substrate and a solvent-soluble resin film laminated thereon, wherein said resin film is of a thickness in the range of 0.1–100 μm, the process comprising the steps of:

providing said stencil printing sheet;

contacting a solvent with said solvent-soluble resin film of said stencil printing sheet by feeding said solvent in a non-contact condition from a solvent-ejecting device, to perforate the contacted resin film, wherein said resin is water-soluble or a water-miscible resin selected from the group consisting of polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal and polyacrylamide, and said solvent is water or an aqueous solvent and, a viscosity of a solution of said solvent into which said resin is dissolved is 1000 cps or less at 20° C., when 10% of the solution's weight is the dissolved resin.

2. A process for perforating a stencil printing sheet according to claim 1, wherein said resin is polyvinyl alcohol or polyvinyl ether.

3. A process for perforating a stencil printing sheet which comprises a porous substrate and a solvent-soluble resin film laminated thereon, wherein said resin film is of a thickness in the range of 0.1–100 μm, which comprises the steps of:

providing said stencil printing sheet;

contacting a solvent with said solvent-soluble resin film of said stencil printing sheet by feeding said solvent in a non-contact condition from a solvent-ejecting device, to perforate the contacted resin film, wherein said resin is selected from the group consisting of polyethylene, polypropylene, polyisobutylene, polystyrene, polyvinyl chloride, polyvinylidene chloride, polyvinyl fluoride, polyvinyl acetate, polyvinyl chloride-polyvinyl acetate copolymer, acrylic resin, polyamide, polyimide, polyester, polycarbonate and polyurethane, and said solvent is at least one solvent selected from the group consisting of an aliphatic hydrocarbon, an aromatic hydrocarbon, an alcohol, a ketone and an ester and an oxide and, a viscosity of a solution of said solvent into which said resin is dissolved, is 1000 cps or less at 20° C., when 10% of the solution's weight is the dissolved resin.

4. A process for perforating a stencil printing sheet according to claim 3, wherein said resin is polycarbonate, and said solvent is a mixed solvent of aromatic hydrocarbon, ketone, and alcohol.

5. A process for perforating a stencil printing sheet according to claim 3, wherein said resin is polyvinyl chloride-polyvinyl acetate copolymer, and said solvent is a mixed solvent of aromatic hydrocarbon, oxide, and ketone.

* * * * *